US005370102A

United States Patent [19]

Peck

[11] Patent Number: 5,370,102

[45] Date of Patent: Dec. 6, 1994

[54] CALIPER BOW STRING RELEASE WITH MOUNTABLE SEAR ELEMENTS

[75] Inventor: Paul L. Peck, Fond du Lac, Wis.

[73] Assignee: Tru-Fire Corporation, North Fond du Lac, Wis.

[21] Appl. No.: 35,815

[22] Filed: Mar. 23, 1993

[51] Int. Cl.[5] ..... F41B 5/18

[52] U.S. Cl. ..... 124/35.2

[58] Field of Search ..... 124/35.2

[56] References Cited

U.S. PATENT DOCUMENTS 228,302 6/1880 Beard ..... 124/35.2

4,407,260 10/1983 Lyons ..... 124/35.2

5,070,854 12/1991 Peck ..... 124/35.2

5,076,251 12/1991 Peck ..... 124/35.2

*Primary Examiner*—Dennis L. Taylor

*Assistant Examiner*—John A. Ricci

*Attorney, Agent, or Firm*—Robert C. Curfiss

[57] ABSTRACT

A caliper bow string release with pivotal jaws includes holders at the outer ends of the jaws for mounting discreet and independent sear elements. The sear elements may be mounted in a fixed position relative to the holders or in a floating position relative to the holders. The sear elements may have a complex string-bearing surface conforming to the periphery and the shape of the string as it is engaged by the release mechanism. The sear elements may also be adapted to engage the string both above and below the nock of a typical arrow.

18 Claims, 2 Drawing Sheets

FIG. 1
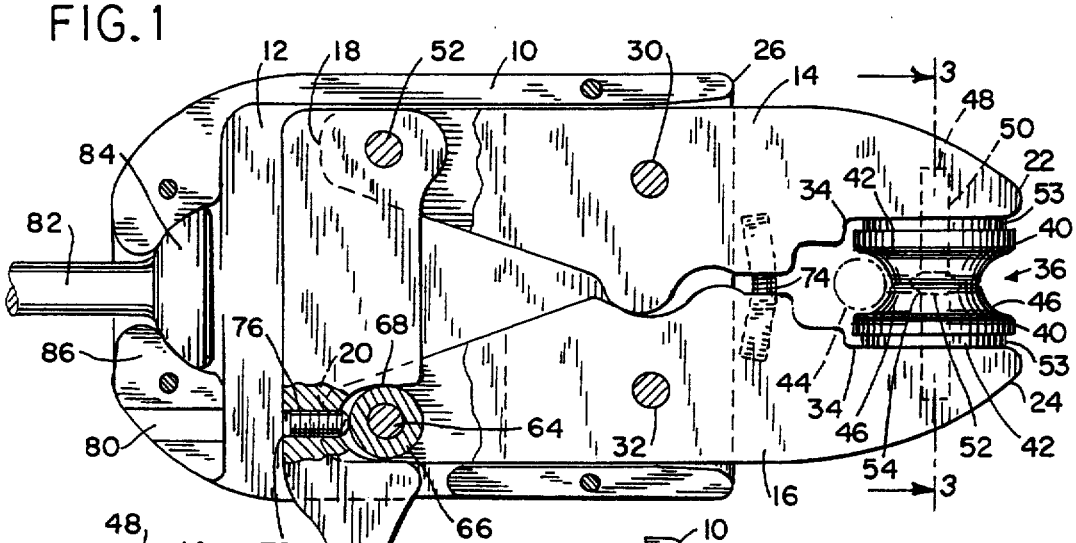
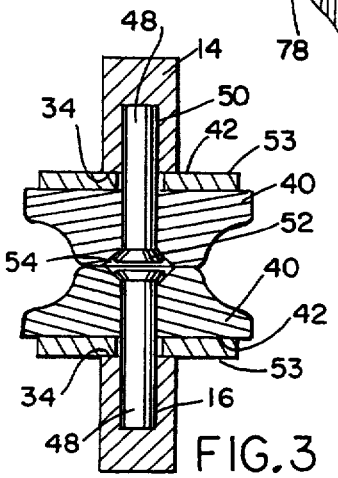
FIG. 3
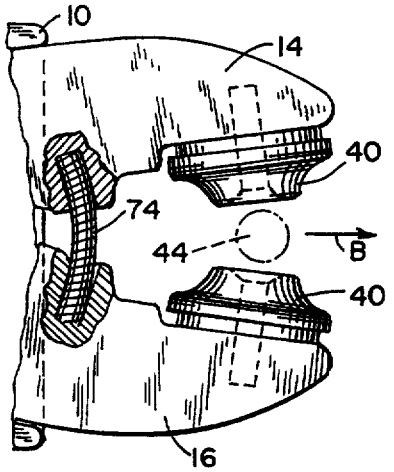
FIG. 2
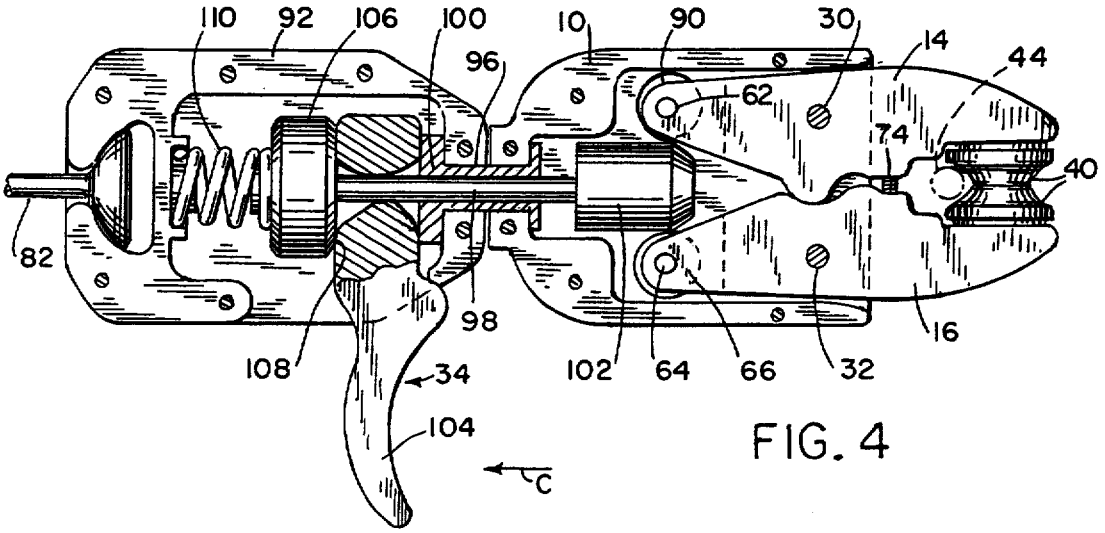
FIG. 4

FIG. 5
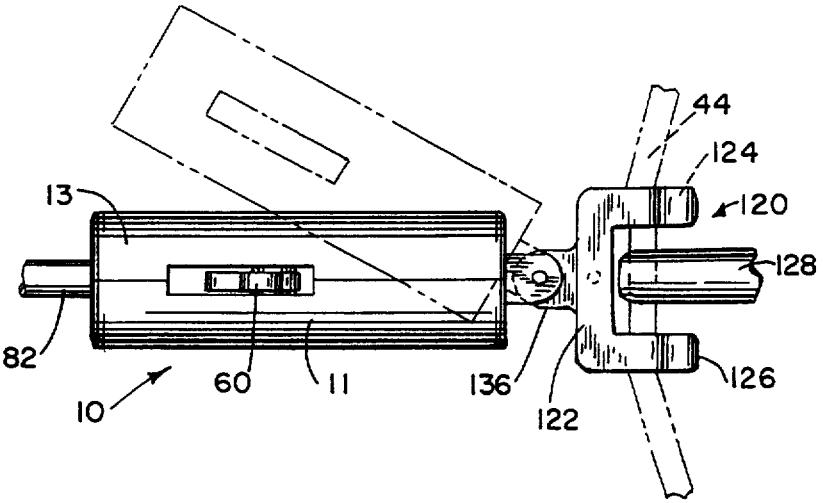
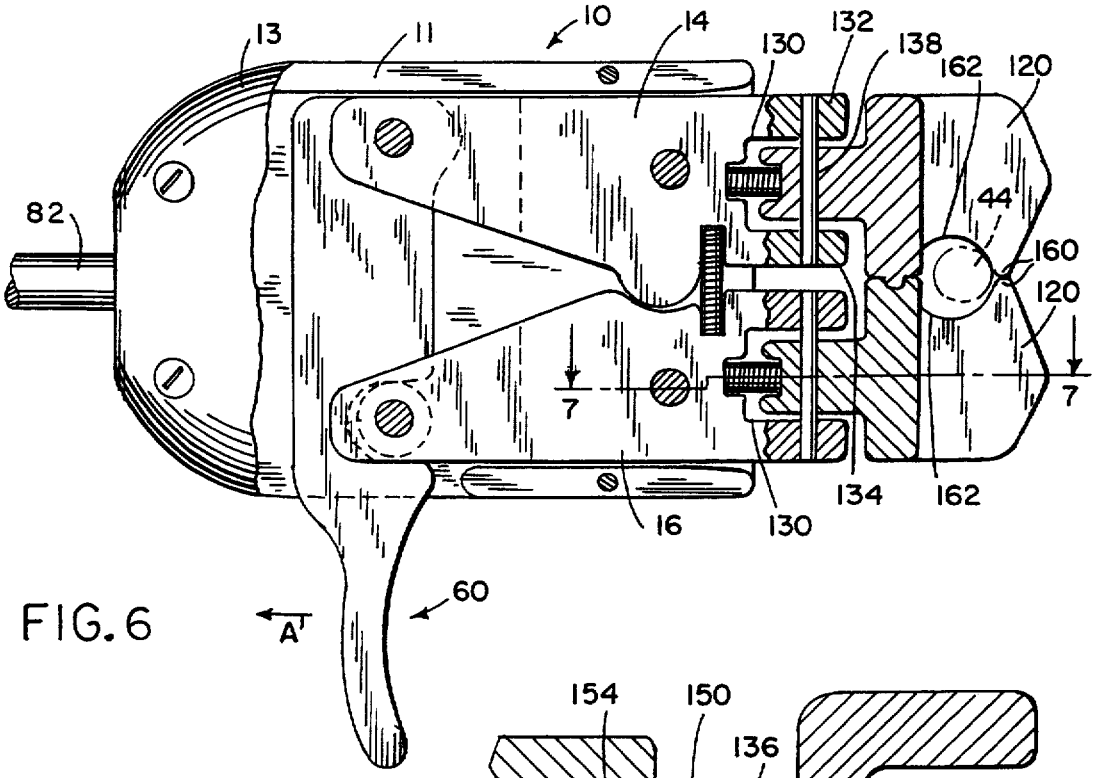
FIG. 6
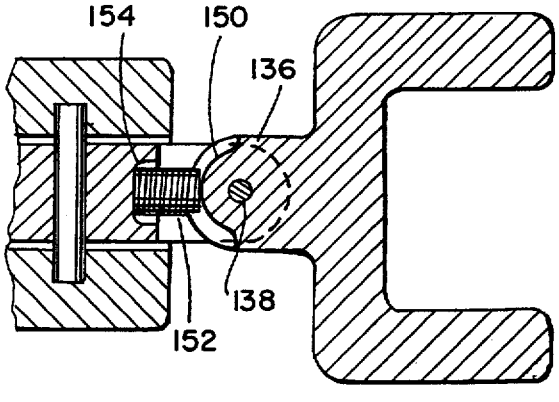
FIG. 7

CALIPER BOW STRING RELEASE WITH MOUNTABLE SEAR ELEMENTS

BACKGROUND OF INVENTION

1. Field of the Invention

This invention is directed to bow string releases and is specifically directed to a caliper motion bow string release having mountable sear elements.

2. Description of the Prior Art

Bow string releases have grown in popularity for target shooting and for hunting. A good release provides uniform release of the bow string and increases accuracy. The release is either hand held or strapped to the wrist and has a trigger which permits the archer to release the string. Typically, such devices employ a pivotal finger that engages the bow string, the finger being pivoted to a release position for releasing the string. Releases of this type are illustrated in U.S. Pat. Nos. 4,066,060; 3,898,974; and 3,954,095. It is also known to use ball elements in place of the pivotal finger to retain and release the string wherein the ball elements are held by a head and retained in position by a yoke or sleeve. A device of this type is illustrated in U.S. Pat. No. 4,403,594. Discreet sear element releases such as the ball releases have gained wide-spread popularity. Examples of discreet element sear releases are shown in U.S. Pat. Nos. 4,926,835; 5,070,854; 5,076,251; and 5,078,116. Most of these devices employs a yoke-type mechanism with an axial motion trigger.

While such devices have proven to be very acceptable and very desirable, there remains a percentage of archers who prefer the caliper-type movement such as that shown in U.S. Pat. No. 4,407,260. Specifically, the caliper type motion includes a pair of elongated jaws mounted for pivotal movement within the head of the release, wherein the jaws pivot outwardly when the trigger is pulled to release the bow string. Variations of caliper-type releases are shown and described in U.S. Pat. Nos. 5,076,251; and 5,078,116, and include discreet sear elements.

Use of discreet sear elements are desirable from a manufacturing standpoint because this allows the sear elements to be precision formed to conform to the shape of the bow string while reducing the overall cost of the release by also permitting the closure mechanism, the head, the body and other elements to be made of less expensive materials. When the closure mechanism and the sear are integral components, the need for precision conflicts with efforts at cost control.

Thus, there remains a need for a caliper motion bow string release which is adapted for receiving discreet sear elements, permitting a caliper motion while incorporating precision sears which may be adapted to conform to the bow string and relieve the fatigue on the string caused by repeated use of the bow string release mechanism.

In addition, bow string releases have recently been developed which permit the bow string to be engaged both above and below the nock of an arrow. An example of such a release is shown and described in my copending application Ser. No. 07/758,779 filed on Sep. 12, 1991. While this has proven to be beneficial in holding the string in a vertical position for providing better engagement with the arrow nock, it is required that the release mechanism be pulled in a linear fashion in axial alignment with the arrow to assure that the string is not cocked. If the string is off the vertical line, the nock can fall out of the mechanism, or result in a misfire. Therefore, there remains a need to provide discreet sear elements in such a mechanism, wherein the elements can be mounted for movement independently of the head to assure accurate firing of the arrow.

SUMMARY OF THE INVENTION

The subject invention is directed to a caliper motion bow string release of a type having a pair of opposed, elongated jaws mounted in a head for pivotal movement between open and closed positions, wherein the outer ends of the jaw include a holder designed for carrying discreet and independent sear elements. This permits the sear elements to be made of a precision material and precisely formed or machined to conform to the shape of the string, for more naturally holding the string and reducing fatigue on the string through repeated use of the bow string release.

In a first embodiment of the invention, the sear elements have string engaging surfaces which are of a concave contour and substantially conform to the shape of the string both peripherally and in the vertical direction, causing minimum fatigue and wear and tear on the string when the string is engaged by the sear mechanisms.

In a second embodiment of the invention, the discreet and independent sear elements include an upper and lower string engaging surface for providing spaced engagement of the string above and below the nock of an arrow, assuring that the string is orthogonal to the axis of the arrow when it is engaged by the nock. In this embodiment of the invention, the discreet sear elements are mounted in a pivotal arrangement with the jaws, permitting the jaws and head of the bow string release to be tilted or to move independently of the sears, assuring that the string is maintained in a vertical position regardless of the tilt or regardless of the ability of the archer to pull the release in axial alignment with the arrow, assuring that the arrow nock stays firmly engaged with the string, for better assurance of a true and accurate firing of the arrow upon release of the mechanism.

The subject invention is equally well-suited for bow string releases including a trigger mechanism which is mounted in the head and activated by pivotal motion of the trigger or a more complex trigger mechanism which is mounted in an independent body and has an axial trigger release engaged with the jaws for controlling the sear action.

It is, therefore, an object and feature of the subject invention to provide a caliper bow string release with discreet, mountable sear elements.

It is another object and feature of the invention to provide a caliper bow string release having mountable sear elements which conform substantially to the shape and contour of the bow string when it is engaged by the sear mechanism.

It is yet another object and feature of the invention to provide for a dual engagement bow string release for engaging the string above and below the nock of an arrow, wherein the sear elements are pivotable relative to the head of the release, assuring proper alignment of the string, arrow and sears regardless of the angle of the bow string release head.

Other objects and features of the invention will be readily apparent from the accompanying drawings and detailed description of the preferred embodiments.

BRIEF DESCRIPTION OF THE DRAWINGS

FIG. 1 is a top plan view, with cover removed, of a caliper bow string release in accordance with the subject invention, showing the jaws in the closed position.

FIG. 2 is a fragmentary view looking in the same direction as FIG. 1, showing the jaws in the opened release position.

FIG. 3 is a section view taken along line 3—3 of FIG. 1.

FIG. 4 is an alternative embodiment of a bow string release in accordance with the subject invention, looking in the same direction as FIG. 1 and showing a bow string release having an axial motion trigger mounted in a body which is independent of the bow string release head.

FIG. 5 is a side plan view of another alternative embodiment of the bow string release in accordance with the subject invention, showing discreet and mountable sear elements adapted for securing the string above and below the nock of a typical arrow.

FIG. 6 is a view of the bow string release of FIG. 5, looking in the same direction as FIGS. 1 and 4, with cover removed.

FIG. 7 is a partial section view taken along line 7—7 of FIG. 6.

DETAILED DESCRIPTION OF THE PREFERRED EMBODIMENTS

A first embodiment of the bow string release in accordance with the subject invention is shown in FIGS. 1-3 and includes a head 10 having a recess 12 adapted for housing a pair of caliper jaws 14 and 16. Each of the jaws 14 and 16 have inner ends 18 and 20, respectively, contained within the head 10 and outer ends 22 and 24, respectively extending beyond the open end 26 of the head. As is typical of caliper-type bow string releases, the jaws 14 and 16 are mounted for pivotal movement on posts 30 and 32, respectively. Each outer end 22, 24 includes a holder defined by the recessed wall 34 which is spaced inwardly from the edge of the jaws, as shown, providing a gap 36 between the jaws when the jaws are in the closed position shown in FIG. 1. Each wall 34 defines a holder for seating a sear element 40.

In the preferred embodiment, each sear elements 40 includes a flat bearing wall 42 adapted to be received in the holder. Where desired, a spacer such as washer 53 may be positioned between sear element 40 and wall 34. The outer end of each sear element 40 is concave contoured as at 42 to conform to the perimeter of a typical bow string, shown in phantom at 44. The specific shape of the contour is ideally suited for engaging the bow string 44 since it conforms both to the perimeter of the bow string and provides an arcuate path for seating the "v" of the bow string as it is pulled, assuring that the bow string is not in engagement with any sharp edges or corners and thereby reducing fatigue and wear and tear on the string through repeated use of the release mechanism. In addition, it is desirable to provide a radius at the outer edge 46 of each sear element 40 to eliminate sharp corners as the bow string is released through the opening of the jaws.

In the embodiment shown, a post 48 extends beyond the bearing wall or surface 42 of each sear element and is received in a socket or receptacle 50 in each jaw. The post may be an integral member or portion of the sear element or it may be a pin extending through the sear element, as shown. Where desired, the post 48 may include an enlarged head 52 which is adapted to be received in a suitable recess 54 provided in the outer wall of the sear elements. The post may be a threaded screw which may be received in a tapped socket or receptacle 50, whereby the sear element is mounted in the respective jaw.

In the embodiment shown in FIGS. 1-3, a head-mounted trigger mechanism 60 is utilized. Each jaw 14, 16 contains a post 62, 64, respectively, adjacent to the jaw inner ends 18 and 20. The post 64 includes a roller 66 mounted for rotation. The trigger 60 comprises an elongated lever which is pivotally mounted on post 62 and includes an intermediate notch 68 for receiving the roller 66. The outer end 70 of the trigger element 60 defines an actuator adapted to be engaged by the finger of an archer for releasing the mechanism. When the trigger actuator 70 is moved in the direction of arrow A, the notch 68 is disengaged from the roller 66 and the jaws 14 and 16 are spread apart by the force of the bow string 44, permitting the jaws to open and the string to be released in the direction of arrow B, as shown in FIG. 2, for firing the arrow. In the preferred embodiment, a biasing element such as the compression spring 74 is mounted between the jaws 14 and 16 for continuously urging the mechanism into the opened position.

Where desired, the trigger travel may be adjusted by adjusting means such as the set screw 76 which is mounted in a tapped through-hole 78 in the trigger lever and is in engagement with the notch 68 for controlling the maximum movement of the notch and trigger relative to the roller 66. A through-hole 80 is provided in the body 10 of the release, permitting access to the set screw 76. A coupler mechanism 82 is provided for securing the bow string release to a wrist strap or the like. In the preferred embodiment, the head 10 is rotatable relative to the coupler 82, as indicated by the radial outer end 84 of the coupler, which is received in a suitable seat 86 provided in the head.

A second embodiment of a bow string release in accordance with the subject invention is shown in FIG. 4. As there shown, the jaws 14 and 16 are mounted on pins 30 and 32, as in the embodiment of FIGS. 1-3. Jaw 16 includes a post 64 for mounting a roller 66, in a manner similar to that shown in FIG. 1. Jaw 14 has been modified to include a roller 90 on post 62. An independent body 92 is provided for housing a trigger mechanism 94. In the embodiment shown, the body 92 is mounted for rotation relative to the head 10, on a cylindrical sleeve 96. The trigger shaft 98 is received in and passes through the sleeve the central aperture 100 in the sleeve 96. The head end 102 of the trigger is enlarged and is adapted for engaging the rollers 66 and 90. The shaft 98 is adapted to be moved between the advanced position shown in FIG. 4 and a retracted position. In the advanced position both rollers 66 and 90 are engaged for locking the sear elements 40 in the closed position shown and consistent with the closed position shown in FIG. 1. When the shaft 98 is retracted in the direction of arrow C, the head end 102 is retracted into disengagement with the rollers 64 and 90, permitting the jaws to open in a manner similar to that shown in FIG. 2, per,-hitting the string 44 to be released.

In the embodiment of FIG. 4, the trigger lever 104 is mounted on the shaft 98 and is secured in place thereon by an end piece 106. When the trigger is pulled in the direction of arrow C, the abutment surface 108 of the trigger lever engages the end piece 106 and forces the shaft in the direction of arrow C, for releasing the string release. In the preferred embodiment, a biasing means such as compression spring 110 is provided for continuously urging the trigger mechanism into the advanced position and into engagement with the rollers 66 and 90 of the jaws 16 and 14, respectively. The body 92 is attached to a coupler 82 by which the bow string release mechanism may be secured to a wrist strap or the like.

The embodiment of FIGS. 5–7 includes a head 10 and trigger mechanism 60 similar to that shown in FIGS. 1–3. The base 11 and cover 13 art shown in FIG. 5. The cover has been removed from FIG. 6, for clarity. In the embodiment of FIGS. 5–7, the outer ends of the jaws 14 and 16 have been modified to define an alternative sear holder which is adapted for mounting the dual engagement sear element 120. The element 120 has a substantially C-shaped appearance with a longitudinal base 122 and a pair of spaced radial sear-defining members 124 and 126 for securing the bow string 44 both above and below the nock of a typical arrow 128. In the embodiment of FIGS. 5–7, the sear element holder at the outer end of the jaws 14 and 16 comprises a channel or recess 130 with outer walls 132 and 134. Each sear element 120 includes a mounting tab 136 which extends outwardly from the longitudinal base portion 122 and is received in the channel 130 of the sear holder. A pin 138 is mounted in the outer walls 132 and 134 of the holder and extends through the tab 136. This permits the sear elements 120 to pivot about pin 138 and relative to the jaws 14 and 16, respectively, and the head 10, as specifically shown in FIG. 5. In the preferred embodiment, the freedom of movement of the sears 120 relative to the head 10 may be controlled by providing a friction-bearing element. As is best shown in FIG. 7, the outer end of the tab 136 may include a radial bearing surface 150. A biasing member such as the compression spring 152 may be positioned in a recess or pocket 154 provided in the end wall of the channel 130 for engaging the radial surface 150 of the tab, continuously providing a friction force for restricting the freedom of movement of the sear elements 120 relevant to the head 10.

As will be noted in FIG. 6, the outer end of the sear element 120 of the preferred embodiment includes an abutment tip 160 and a string receptive notch 162. When the jaws are in the closed position shown in FIG. 6, the abutment tips 160 are engagement with one another, defining a closure of the notches 162 for securing the bow string 44. When the trigger mechanism 60 is pulled in the direction of arrow A, in a manner similar to that shown in FIG. 1, the jaws are released and the abutment tips 160 spread apart, for releasing the bow string 44.

Of course, it will be understood that the outer ends of the sear elements 120 could be modified in any desirable fashion, including, but not limited to, providing for the discreet, independent sear elements shown in FIGS. 1–4.

While certain features and embodiments of the invention have been described in detail herein, it will be readily understood that the invention encompasses all modifications and enhancements within the scope and spirit of the following claims.

What is claimed is:

1. A bow string release having a head for housing a string retaining sear mechanism movable between string retaining and string releasing positions, and a trigger associated with the string retaining sear mechanism for selectively engaging the sear mechanism and securing it in the string retaining position for selectively disengaging the sear mechanism for releasing the sear mechanism to the string releasing position, comprising:

a. a pair of opposed, elongated jaws having opposite ends, each jaw mounted in the head for pivotal movement between opened and closed positions, one end of each jaw in direct communication with the trigger such that the jaws are secured in the closed position when engaged by the trigger and are released to the open position when disengaged by the trigger;

b. the other end of each jaw including a holder;

c. a discreet sear element mounted in the holder of each jaw, such that the sear elements in the pair of jaws are in abutting contact with one another for retaining the string when the jaws are engaged by the trigger and are moved to a non-abutting position when the jaws are disengaged by the trigger;

d. wherein each sear element has an inner end in abutting relationship with the respective jaw and an outer end conforming to the contour of the bow string; and e. wherein the outer end of each sear element includes a concave contour peripheral wall and a substantially flat outer surface substantially orthogonal to the axis of the sear element.

2. The bow string release of claim 1, wherein the holder of each jaw includes a flat recess adapted for engaging and seating the respective sear element.

3. The bow string release of claim 2, wherein each sear element includes a flat mounting surface adapted to be received in and aligned with the flat recess of the holder in the respective jaw.

4. The bow string release of claim 1, wherein the holder of each jaw includes a socket and wherein each sear element includes a mounting pin extending therefrom and adapted to be received and secured in the socket for securing the respective sear element in the respective holder.

5. The bow string release of claim 4, wherein the pin is an integral component of the sear element.

6. The bow string release of claim 4, wherein the sear element includes a through, axial hole and wherein the pin is adapted to pass through the hole and extend beyond the sear element and into the receptacle of the respective holder.

7. The bow string release of claim 6, wherein the pin further includes a head larger than the through hole in the sear element and the sear element further includes a head receptive recess for seating the head.

8. The bow string release of claim 4, wherein the receptacle is tapped and the pin is threaded with complementary threads, whereby the sear element may be secured in the respective holder by turning the pin into the receptacle.

9. The bow string release of claim 1, further including a biasing element positioned between and in communication with the two jaws for normally urging the jaws into the opened position.

10. The bow string release of claim 9, wherein the biasing element further comprises a compression spring positioned between pivot point and the other end of each jaw.

11. The bow string release of claim 1, wherein the trigger is mounted in the head.

12. The bow string release of claim 11, the trigger further including a post projecting outwardly from each of said jaws adjacent to the said one end thereof, a roller mounted on one of said posts, an elongated trigger-defining lever having opposite ends with one end mounted for pivotal movement on one of said posts and the other end extending beyond said head and adapted to be engaged by a finger whereby the trigger may be pivoted about said one post between jaw engaging and jaw disengaging positions, and a notch in said lever and adapted for receiving said roller when said trigger is in the jaw engaging position.

13. The bow string release of claim 12, the trigger further including means for adjusting the depth of the notch for selectively adjusting the travel of the trigger between the engaging and disengaging positions.

14. The bow string release of claim 13, wherein said means for adjusting the depth of the notch further includes a tapped, through hole in the lever and in communication with the notch and a threaded set screw received in the hole and having an outer end adapted for engaging the roller.

15. The bow string release of claim 1, further comprising a body separate from the head for housing the trigger, means for rotatably mounting the body to the head, the trigger further including an elongated shaft having one end in the body and an opposite end in the head, the shaft adapted to be axially moved between advanced and retracted positions, and the head end adapted for engaging and maintaining said one end of each jaw in the closed position when the shaft is in the advanced position.

16. The bow string release of claim 15, further including biasing means mounted in the body for urging the shaft into the advanced position.

17. The bow string release of claim 15, further including means for adjusting the maximum advancement of the shaft relative to the jaws.

18. A bow string release having a head for housing a string retaining sear mechanism movable between string retaining and string release positions, and a trigger associated with the string retaining sear mechanism for selectively engaging the sear mechanism and securing it in the string retaining position and for disengaging the sear mechanism for releasing the sear mechanism to the string releasing position, comprising:

a. a pair of opposed, elongated jaws having opposite ends, each jaw mounted in the head for pivotal movement between opened and closed positions, one end of each jaw in direct communication with the trigger such that the jaws are secured in the closed position when engaged by the trigger and are released to the open position when disengaged by the trigger;

b. the other end of each jaw including a holder including a flat recess adapted for seating the respective sear element;

c. a discreet sear element including a flat mounting surface adapted to be received in and engaged by the flat recess of the holder in the respective jaw for mounting the sear element in the respective jaw, such that the sear elements in the pair of jaws are abutting contact with one another for retaining the string when the jaws are engaged by the trigger and are moved to a non-abutting position when the jaws are disengaged by the trigger; and d. wherein the holder of each jaw further includes a socket and wherein each sear element includes a mounting pin extending therefrom and adapted to be received and secured in the socket for securing the respective sear element in the respective holder.

* * * * *